US010865663B2

(12) United States Patent
Weber et al.

(10) Patent No.: US 10,865,663 B2
(45) Date of Patent: Dec. 15, 2020

(54) CAMSHAFT ADJUSTING SYSTEM WITH FLEX POT FOR DECOUPLING OF THE ADJUSTMENT RANGES

(71) Applicant: Schaeffler Technologies AG & Co. KG, Herzogenaurach (DE)

(72) Inventors: Jurgen Weber, Erlangen (DE); Marco Hildebrand, Nuremberg (DE); Daniel Heise, Herzogenaurach (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/514,271

(22) Filed: Jul. 17, 2019

(65) Prior Publication Data

US 2020/0095900 A1 Mar. 26, 2020

(30) Foreign Application Priority Data

Sep. 20, 2018 (DE) ..... 10 2018 123 180

(51) Int. Cl.
*F01L 1/344* (2006.01)
*F01L 1/12* (2006.01)
(Continued)

(52) U.S. Cl.
CPC ..... *F01L 1/12* (2013.01); *F01L 1/3442* (2013.01); *F01L 25/08* (2013.01);
(Continued)

(58) Field of Classification Search
CPC . F01L 1/12; F01L 1/3442; F01L 1/344; F01L 1/34; F01L 1/047; F01L 2001/0475;
(Continued)

(56) References Cited

U.S. PATENT DOCUMENTS

2012/0312262 A1* 12/2012 Hoppe ..... F01L 1/3442 123/90.17
2013/0306011 A1* 11/2013 Wigsten ..... F01L 1/3442 123/90.15

(Continued)

FOREIGN PATENT DOCUMENTS

DE 102015207104 A1 10/2016
EP 3141711 3/2017

*Primary Examiner* — Patrick Hamo
*Assistant Examiner* — Kelsey L Stanek
(74) *Attorney, Agent, or Firm* — Volpe Koenig

(57) ABSTRACT

A camshaft adjusting system (1) is provided for a first camshaft (2) and a second camshaft (3) which are arranged concentrically with respect to one another, the second camshaft (3) being arranged within the first camshaft (2). A vane-cell type hydraulic camshaft adjuster (4) is configured for adjusting the first camshaft (2) and an electric camshaft adjuster (5) is configured for adjusting the second camshaft (3). A front cover (7) which is fastened to a stator (6) of the hydraulic camshaft adjuster (4) and which closes off the camshaft adjuster (4) at a side facing away from the camshaft has an internal toothing (8) for supporting a flex pot (9) which is attached to the second camshaft (3) and which is designed for receiving torque from the electric camshaft adjuster (5). A camshaft adjusting unit having the camshaft adjusting system (1) and two camshafts (2, 3) is also provided.

19 Claims, 11 Drawing Sheets

(51) Int. Cl.
*F01L 25/08* (2006.01)
*F01L 1/047* (2006.01)

(52) U.S. Cl.
CPC ..... *F01L 2001/0475* (2013.01); *F01L 2001/34469* (2013.01); *F01L 2201/00* (2013.01)

(58) Field of Classification Search
CPC ... F01L 2001/34469; F01L 2001/34496; F01L 2001/0537; F01L 2001/34423; F01L 25/08; F01L 2201/00
USPC ..... 123/90.15–90.17
See application file for complete search history.

(56) References Cited

U.S. PATENT DOCUMENTS

| | | | | |
|---|---|---|---|---|
| 2014/0190435 | A1 | 7/2014 | Wigsten et al. | |
| 2019/0353059 | A1* | 11/2019 | Weber | F01L 1/34 |
| 2019/0353237 | A1* | 11/2019 | Weber | F01L 1/3442 |
| 2020/0080448 | A1* | 3/2020 | Weber | F01L 1/12 |

* cited by examiner

CAMSHAFT ADJUSTING SYSTEM WITH FLEX POT FOR DECOUPLING OF THE ADJUSTMENT RANGES

INCORPORATION BY REFERENCE

The following documents are incorporated herein by reference as if fully set forth: German Patent Application No. 10 2018 123 180.6, filed Sep. 20, 2018.

TECHNICAL FIELD

A camshaft adjusting system is provided for a first camshaft and a second camshaft which are arranged concentrically with respect to one another, the second camshaft being arranged within the first camshaft, a vane-cell type hydraulic camshaft adjuster being configured for adjusting the first camshaft and an electric camshaft adjuster being configured for adjusting the second camshaft. Furthermore, a camshaft adjusting unit is provided having the camshaft adjusting system and two camshafts, which are arranged concentrically with respect to one another.

BACKGROUND

Camshaft adjusting systems for two camshafts which are arranged concentrically with respect to one another are already known from the prior art. Here, differences exist for example in the type of the respective adjuster, which may be both electric and hydraulic.

For example, EP 3 141 711 A1 discloses a double camshaft adjuster which is used for an internal combustion engine which has a crankshaft and a valve drive which has a first and a second group of cams, wherein the phase of the cams in each group is adaptable independently of the phase of the cams of the other group relative to the phase of the crankshaft. The double adjuster has an electric first adjuster for controlling the first group of cams and a hydraulic second adjuster for controlling the second group of cams. The axially coupled construction, presented here, between the hydraulic and the electric adjuster however requires a very large structural space.

US 2014/0190435 A1 discloses a variable camshaft adjuster with a first fluid transfer arrangement with a fluid transfer sleeve and/or with a multiplicity of pressurized fluid passages, and with a fluid transfer plate with a multiplicity of pressurized fluid passages. Each passage extends so as to be fluidically connected to a corresponding encirclingly arranged annular channel segment portion for the selective connection to a vane-cell type camshaft adjuster in a manner dependent on angular orientation of the fluid transfer sleeve during the rotation. Each passage, which extends from a corresponding centrally arranged port, is fluidically connected to a radially extending passage portion and to an arcuately extending passage portion.

US 2013/0306011 A1 discloses a variable camshaft adjuster for an internal combustion engine having a concentric camshaft which may comprise a stator with an axis of rotation. An outer rotor can rotate independently relative to the axis of rotation of the stator. A combination of an outer vane and a cavity can be associated with the outer rotor in order to define first and second outer variable volume chamber. A radially inner rotor can rotate relative to the axis of rotation and independently of both the stator and the outer rotor. A combination of an outer vane and a cavity can be associated with the inner rotor in order to define first and second inner variable volume working chambers. If the first and second, inner and outer chambers are selectively connected to a source for pressurized fluid, the phase orientation of the outer and inner rotors relative to another and in relation to the stator is simplified.

A disadvantage of the previously known systems is that the angular adjustments of the first and of the second camshaft, also referred to as intake and exhaust camshafts or inner and outer shafts, by means of the adjusting system are dependent on one another. In this way, an increased adjustment range of the inner shaft is required for the counteraction of the outer shaft. Firstly, this can be implemented only to a limited extent hydraulically, and secondly, the counteraction can prove to be time-consuming and associated with a relatively large control error.

SUMMARY

It is an object to avoid or at least alleviate the disadvantages from the prior art and in particular to provide a system which is expedient from a cost and structural space aspect and which resolves in particular the disadvantages of the large adjustment range of the inner shaft, the time-consuming counteraction of the inner shaft, and the error-afflicted control quality.

This objective is achieved in that a front cover which is fastened to a stator of the hydraulic camshaft adjuster and which closes off the camshaft adjuster at a side facing away from the camshaft has an internal toothing for supporting a flex pot which is attached to the second camshaft and which is designed for receiving torque from the electric camshaft adjuster. Furthermore, the object is also achieved by a camshaft adjusting unit having the camshaft adjusting system and two camshafts, which are arranged concentrically with respect to one another.

In the case of this construction, the use of a collar sleeve and of a separate output internal gear can be eliminated, whereby the overall construction can be realized in particularly flat and expedient form.

Advantageous embodiments are described below and in the claims.

Accordingly, it is advantageous if the front cover is an integral/unipartite/materially coherent constituent part of the stator or is a component separate therefrom. If the front cover is an integral constituent part of the stator, it is also possible for connecting elements, such as for example bolts, to be omitted. Depending on the structural space, it may however also be advantageous if the front cover is formed as a component separate from the stator, for example in order to simplify the assembly process.

It is furthermore advantageous if the front cover is divided into a stop component and a toothing component separate therefrom, or the front cover has both a stop and a toothing portion. Here, too, it is dependent on the available structural space whether the two functions are integrated in one component and divided between two separate components, for example in order to simplify the assembly process.

Here, one possible embodiment provides for the stop component or the stop to have a shoulder which prevents an axial movement of the flex pot and/or of a rolling bearing outer shell in the flex pot in the direction of an electric motor of the electric camshaft adjuster, that is to say away from the camshafts. The stop component thus ensures that a displacement in an axial direction is limited or prevented.

It has furthermore proven to be advantageous if an adapter part for conducting oil is arranged in an axial direction between the rotor of the hydraulic camshaft adjuster and the flex pot. This adapter part has internal channels and an annular channel on the outer diameter, via which channels the feed and discharge of the control oil into/out of the pressure chambers of the hydraulic adjuster are made possible.

It is furthermore advantageous if the stop component engages around the front cover. This yields a simple means of assembly, similarly to a spring cover.

Here, a particularly advantageous embodiment provides for frictional engagement, for example an interference fit, to be formed between the stop component and the front cover.

It is advantageous if the flex pot is connected via an intermediate part to the second camshaft. This permits more exact positioning or centering of the flex pot relative to the camshaft.

It is furthermore proven to be advantageous if the electric camshaft adjuster is connected by an Oldham coupling/cross-slot coupling to one of the camshafts. That is to say, the coupling is formed as a non-switchable, rotationally rigid coupling which can compensate a radial offset of two parallel shafts. An Oldham coupling is known per se from the prior art, for which reason this will not be discussed in any more detail at this juncture.

In other words, the adjustment ranges for the outer shaft and for the inner shaft are decoupled through the use of an internally toothed front cover of the hydraulic camshaft adjuster as an internal gear for the flex pot, which is connected fixedly in terms of torque to the inner shaft of the concentric camshaft. The axial mounting of the adjusting shaft is realized either by a step on the inner diameter of the front cover or by a sheet-metal cover pressed onto the front cover outer diameter, analogously to the spring cover in the hydraulic adjuster with the spiral spring. Between the flex pot and the camshaft, there is installed an additional adapter which, with its internal channels and the annular channel on the outer diameter, permits the feed and discharge of the control oil into/out of the pressure chambers A and B of the hydraulic adjuster. A support/plain bearing for the flex pot is formed between the adapter outer diameter and the rotor inner diameter.

A particularly flat construction of the camshaft adjusting system is thus possible. A separate output internal gear is omitted, whereby the system is less expensive and a greater pressure ratio of the hydraulic adjuster can be realized in the same radial structural space. The cost ratio of the integration for the hardening of the locking slotted guide and of the toothing in a heat treatment process is improved. Furthermore, the outer shaft and the inner shaft can be adjusted independently of one another relative to the crankshaft. This electric-hydraulic system thus permits particularly high adjustment speeds of the inner camshaft even at low temperatures below 0° C.

It can thus also be stated that a decoupling is provided of the adjustment ranges for the outer shaft and for the inner shaft through the use of an internally toothed front cover of the hydraulic camshaft adjuster as an internal gear for the flex pot, which is connected fixedly in terms of torque to the inner shaft of the concentric camshaft.

BRIEF DESCRIPTION OF THE DRAWINGS

The embodiments will be discussed in more detail with the aid of figures, in which various embodiments are illustrated and in which.

DETAILED DESCRIPTION

The figures are merely of a schematic nature and serve only for the understanding of the embodiments. The same elements are denoted by the same reference designations.

Features of the individual exemplary embodiments may also be realized in other exemplary embodiments. They are thus interchangeable with one another.

Figure 1:
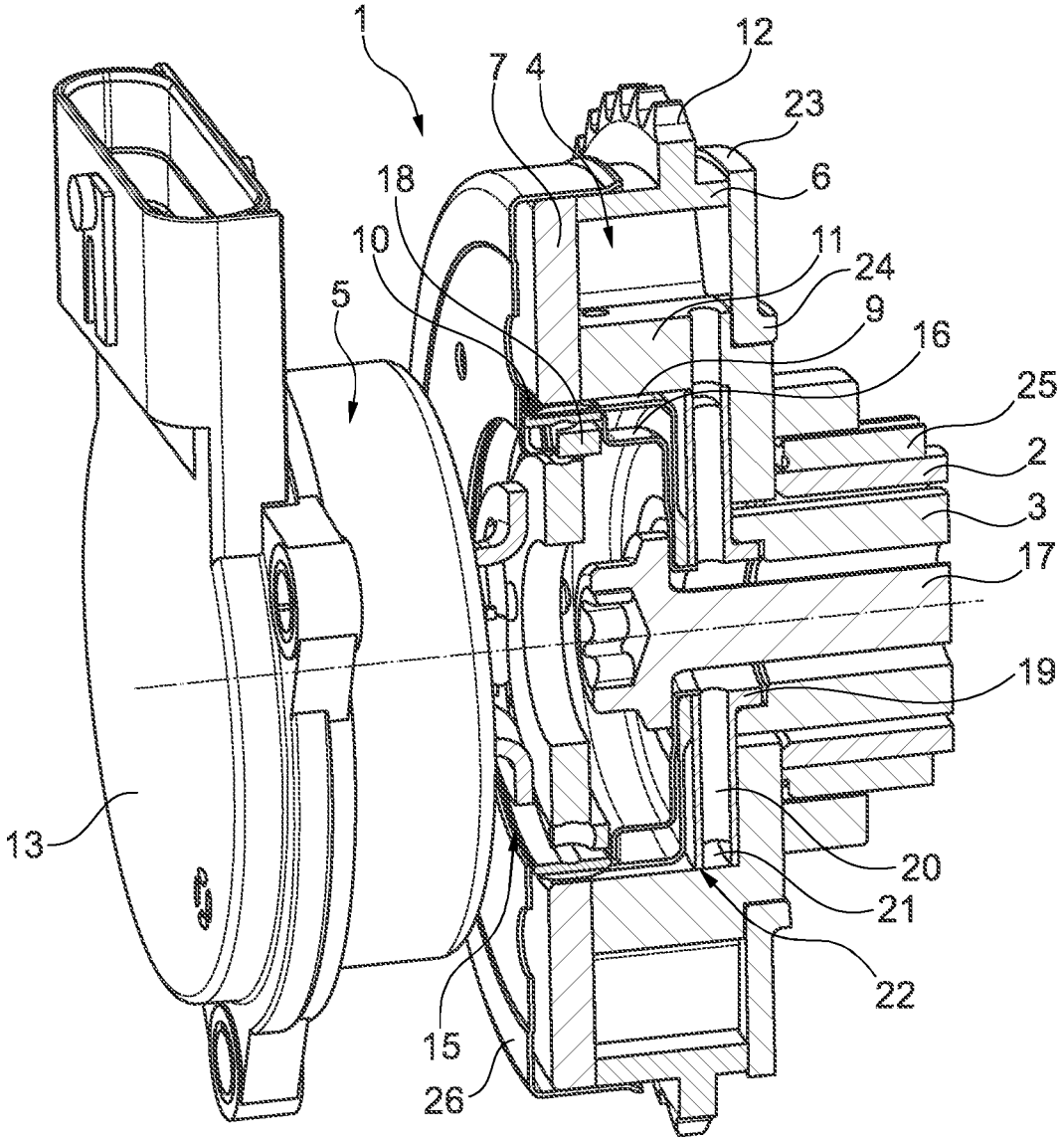
FIG. 1 shows a longitudinal sectional view of a camshaft adjusting system in a first exemplary embodiment in a perspective illustration.

FIGS. 1 to 6 show a camshaft adjusting system 1 in a first exemplary embodiment in different views. FIG. 1 shows the camshaft adjusting system 1 in a longitudinal sectional view. The camshaft adjusting system 1 serves for the adjustment of a first camshaft 2 and of a second camshaft 3, which are arranged concentrically with respect to one another, wherein the second camshaft 3 is arranged radially within the first camshaft 2. The first camshaft 2 is adjusted by a hydraulic vane-cell type camshaft adjuster 4, whereas the second camshaft 3 is adjusted by an electric camshaft adjuster 5. This means that the hydraulic camshaft adjuster 4 acts on the outer camshaft 2 in order to adjust a phase position of the latter, and the electric camshaft adjuster 5 acts on the inner camshaft 3 in order to adjust a phase position of the latter.

Figure 7:
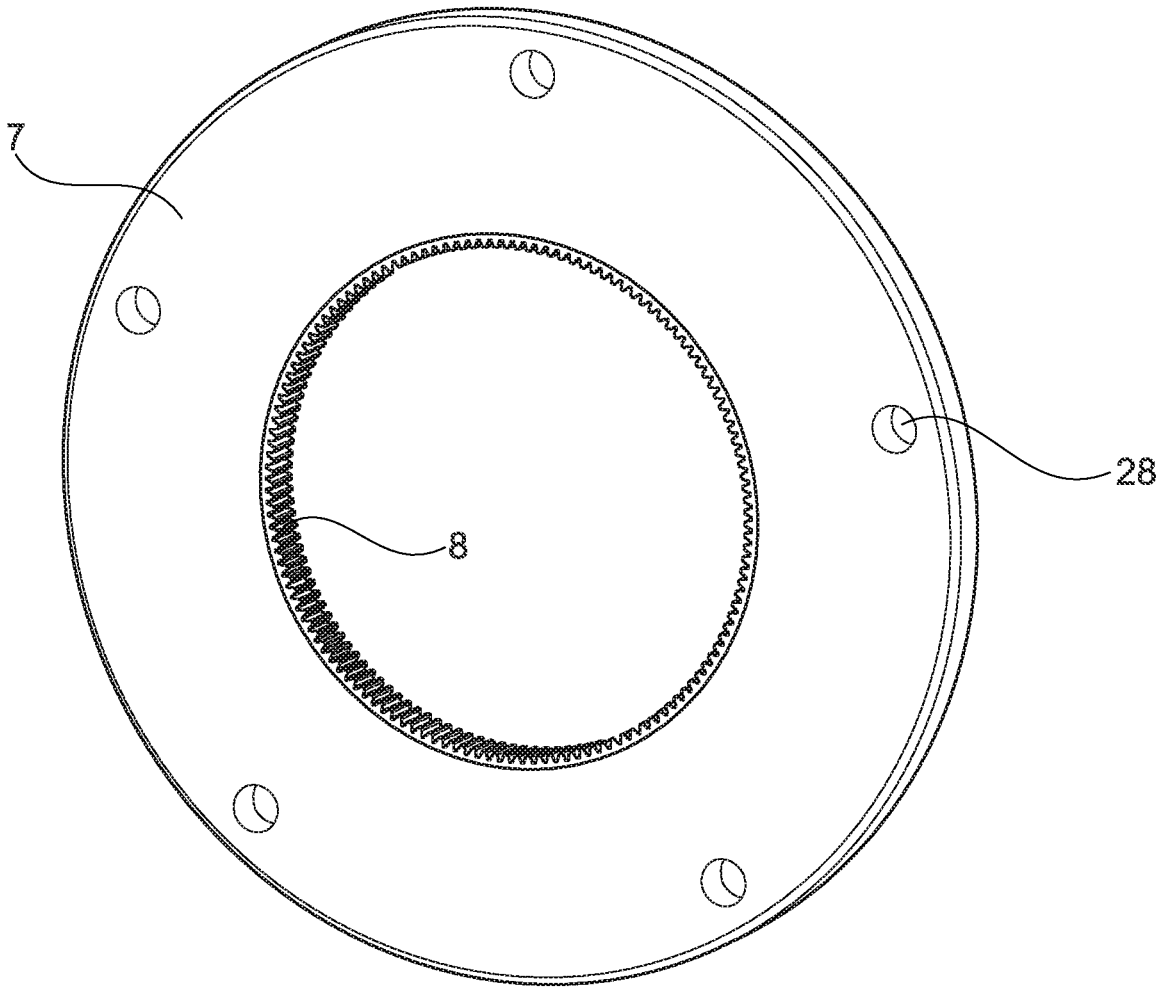
FIG. 7 is a perspective illustration of the front cover in a first exemplary embodiment.
Figure 8:
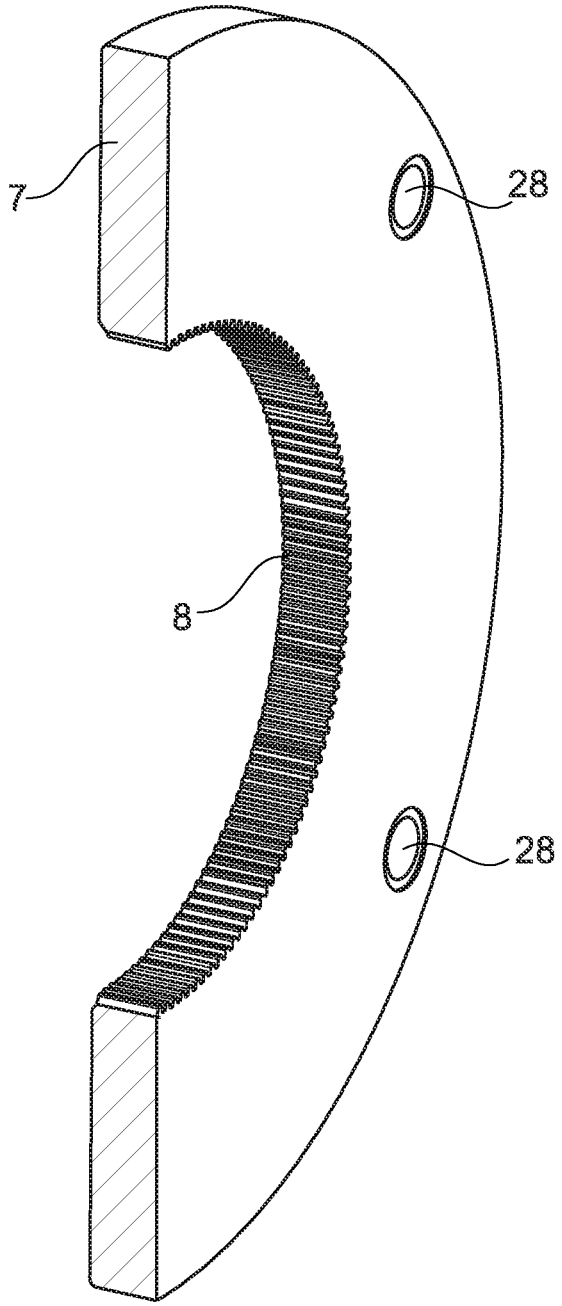
FIG. 8 is a longitudinal sectional view of the front cover illustrated in FIG. 7.
Figure 9:
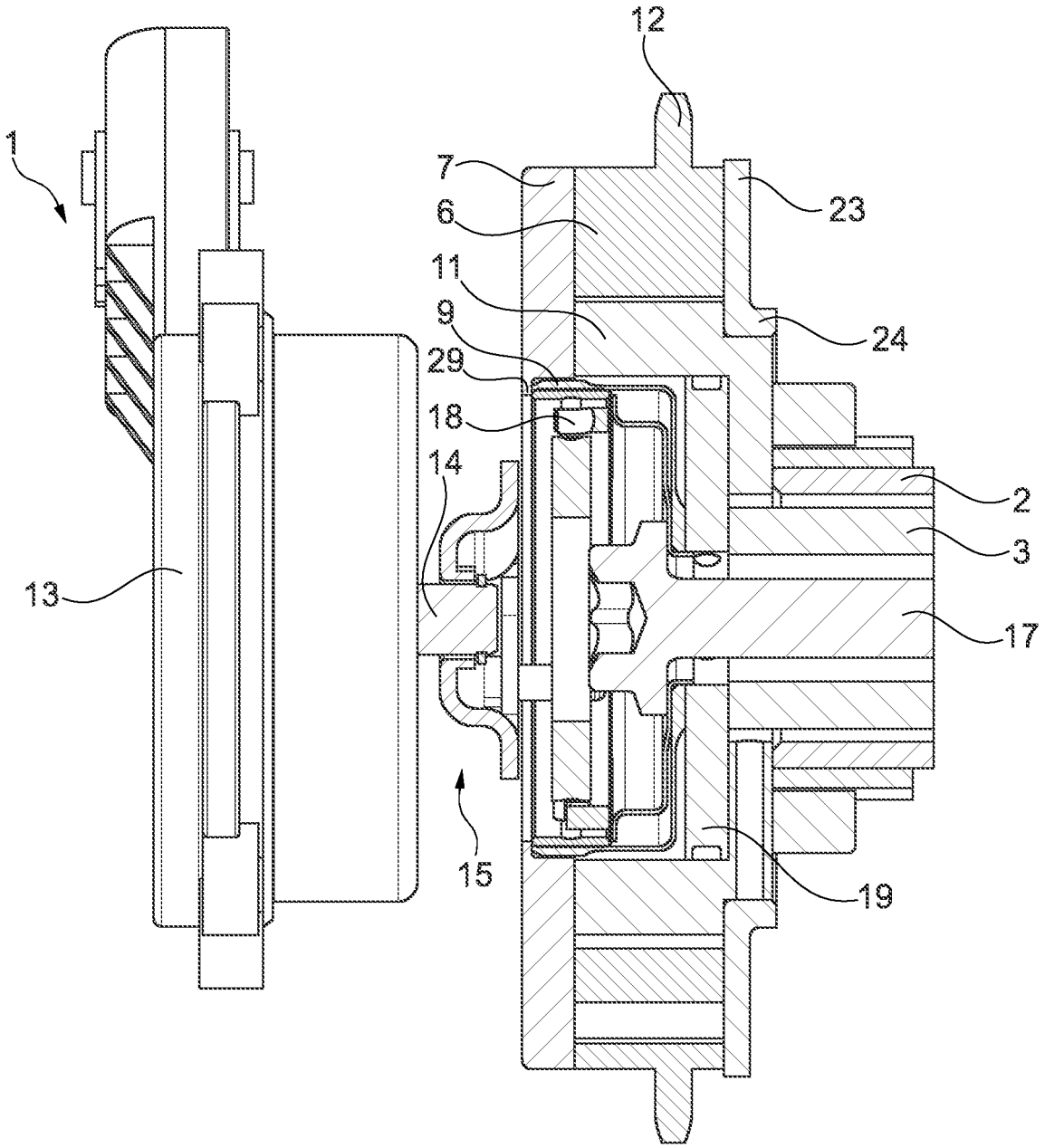
FIG. 9 is a longitudinal sectional view of the camshaft adjusting system and a second exemplary embodiment.
Figure 10:
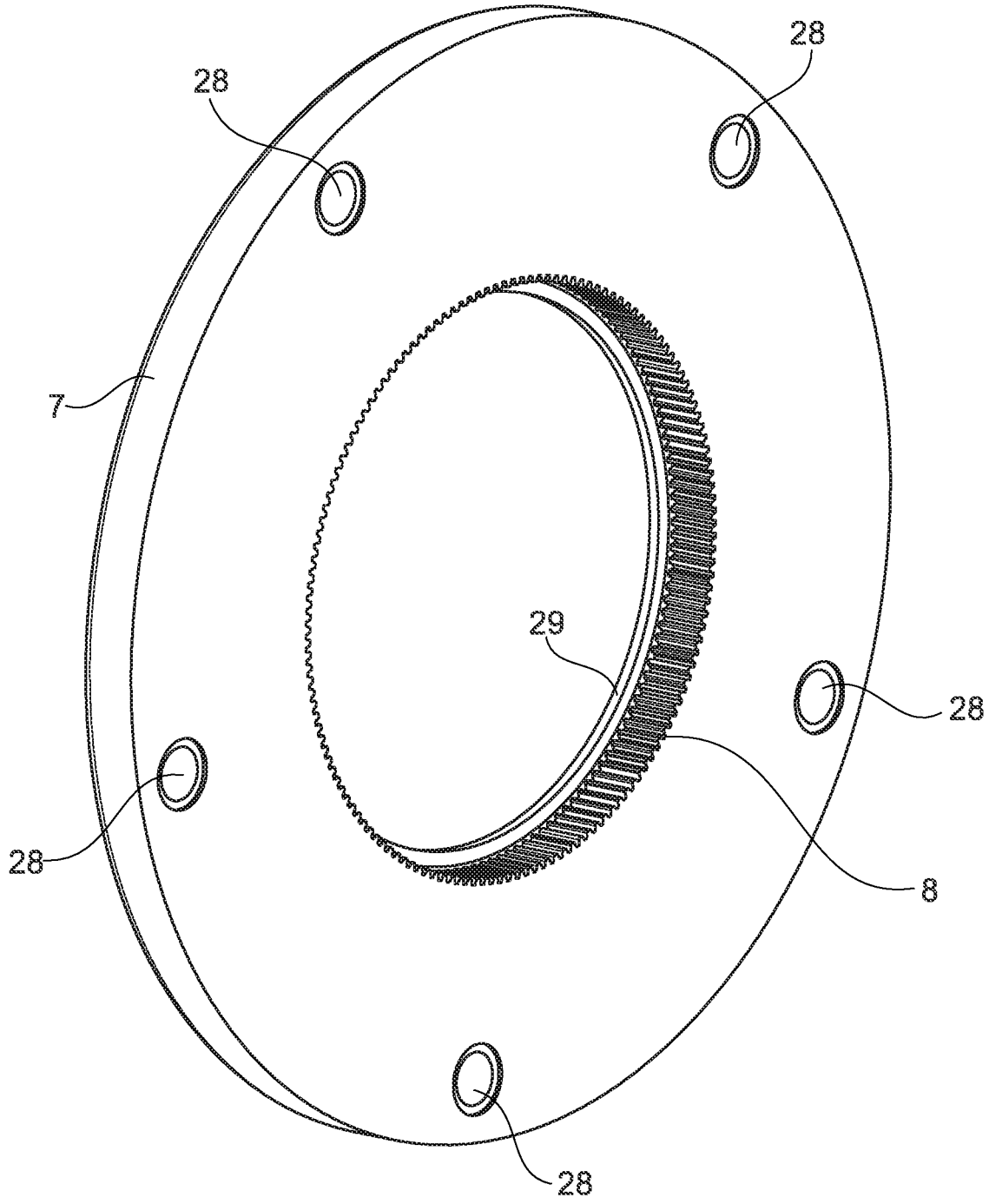
FIG. 10 is an exemplary illustration of the front cover in a second exemplary embodiment.
Figure 11:
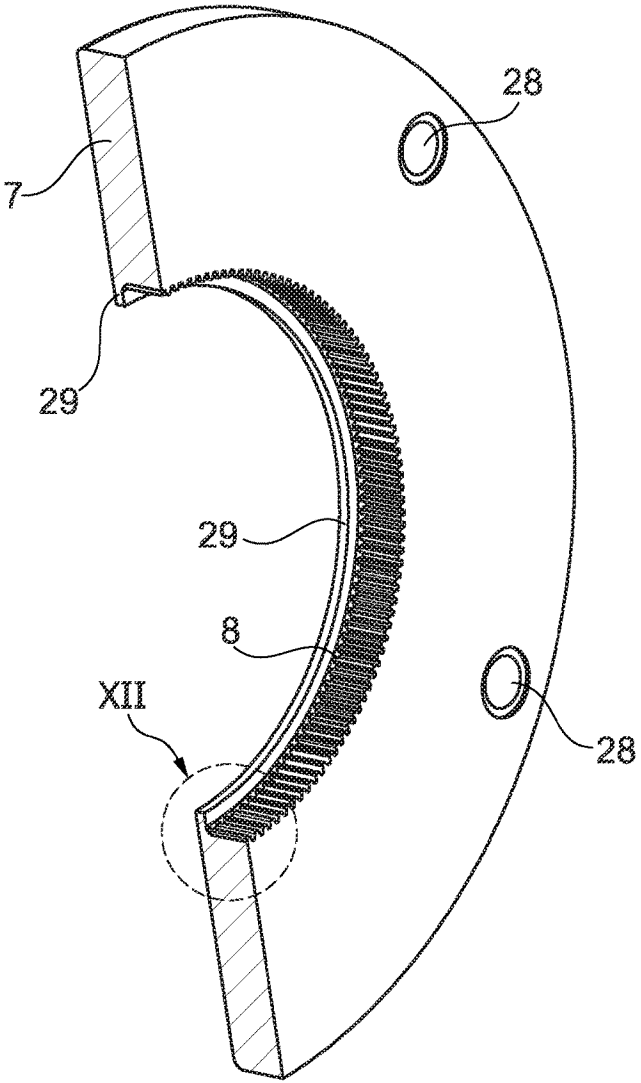
FIG. 11 shows a longitudinal sectional view of the front cover illustrated in FIG. 10.

The hydraulic vane-cell type camshaft adjuster 4 has inter alia a stator 6 which is closed off in an axial direction, on a side averted from the camshafts 2, 3, by an annular front cover 7. The front cover 7 has an internal toothing 8, that is to say a toothing which is formed at its inner diameter (see also FIGS. 7 and 8) and which serves for supporting a flex pot 9, which flex pot is attached to the second camshaft 3 and is designed for receiving torque from the electric camshaft adjuster 5. For this purpose, the internal toothing 8 of the front cover 7 meshes with an external toothing 10 of the flex pot 9, that is to say with a toothing which is formed on an outer diameter of the flex pot 9. Thus, the front cover 7 serves as an internal gear for the flex pot 9, and here, decouples the adjustment ranges for the first camshaft 2 and the second camshaft 3.

Figure 2:
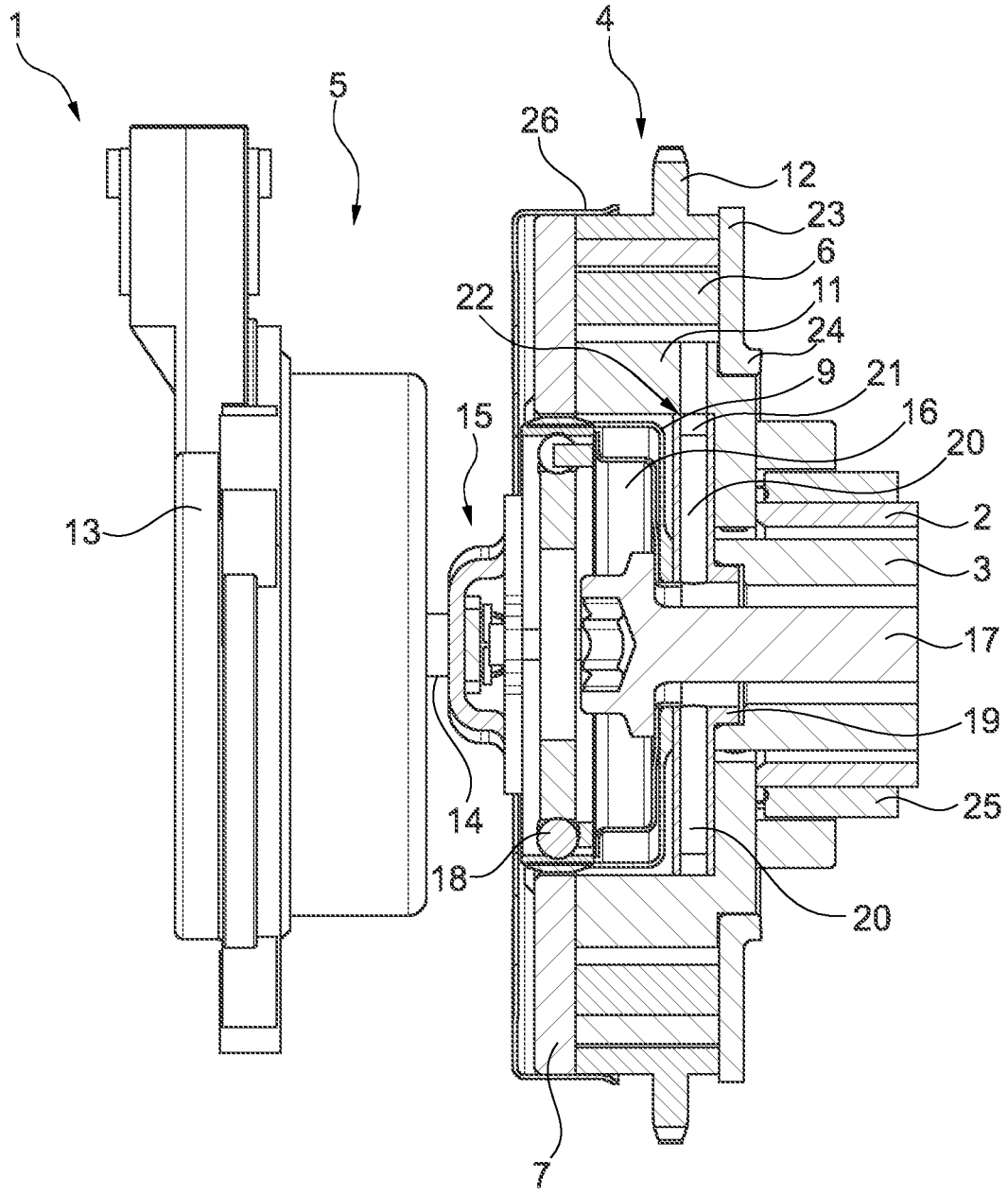
FIG. 2 shows the first exemplary embodiment of the camshaft adjusting system shown in FIG. 1 in a longitudinal sectional view.

With reference to FIGS. 1 and 2, the hydraulic camshaft adjuster 5 will be discussed in more detail below. As already mentioned above, the hydraulic camshaft adjuster 4 has a stator 6 and a radially inner rotor 11 arranged concentrically with respect to said stator, wherein the rotor 11 is mounted so as to be rotatable relative to the stator 6. In the exemplary embodiment shown here, the stator 6 is formed integrally with a drive wheel 12. The drive wheel 12, which is designed here as a sprocket, is thus coupled to the camshafts 2, 3 for the introduction of torque.

The electric camshaft adjuster 5 has an electric motor 13, which has an output shaft 14. This output shaft is coupled in torque-transmitting fashion via an Oldham coupling 15 to the flex pot 9. The flex pot 9 is in turn attached via an intermediate part 16 and a central bolt 17 to the inner, that is to say second, camshaft 3. The Oldham coupling 15 can compensate a radial offset of two parallel shafts. The flex pot 9 is mounted by a rolling bearing 18 on its inner diameter.

Between the second camshaft 3 and the flex pot 9, in an axial direction, there is arranged an (additional) adapter part 19 which has inner channels 20 and an annular channel 21 on the outer diameter. These channels serve for the feed and discharge of the control oil into and out of the pressure chambers A and B of the hydraulic camshaft adjuster 4, which are formed by the stator 6 and the rotor 11. Between the outer diameter of the adapter part 19 and the inner diameter of the rotor 11, there is formed a support or plain bearing 22 for the flex pot 9.

The hydraulic camshaft adjuster 4 is closed off in an axial direction on both sides by in each case one cover, wherein a first cover, arranged on the left in FIG. 2 (that is to say on the side averted from the camshafts 2, 3), corresponds to the front cover 7, and one arranged on the right in FIG. 2 (on the side facing toward the camshafts 2, 3) is formed as an annular cover 23 with a rotor contact flange 24.

The rotor 11 is mounted on the first camshaft 2 by a bearing point 25. In order to prevent an axial displacement away from the camshafts 2, 3, in particular of the construction comprising the flex pot 9, a sheet-metal cover 26, which serves as a separate stop cover, is provided in the first embodiment. The sheet-metal cover 26 is, for this purpose, installed with an interference fit onto the outer diameter of the front cover 7.

Figure 3:
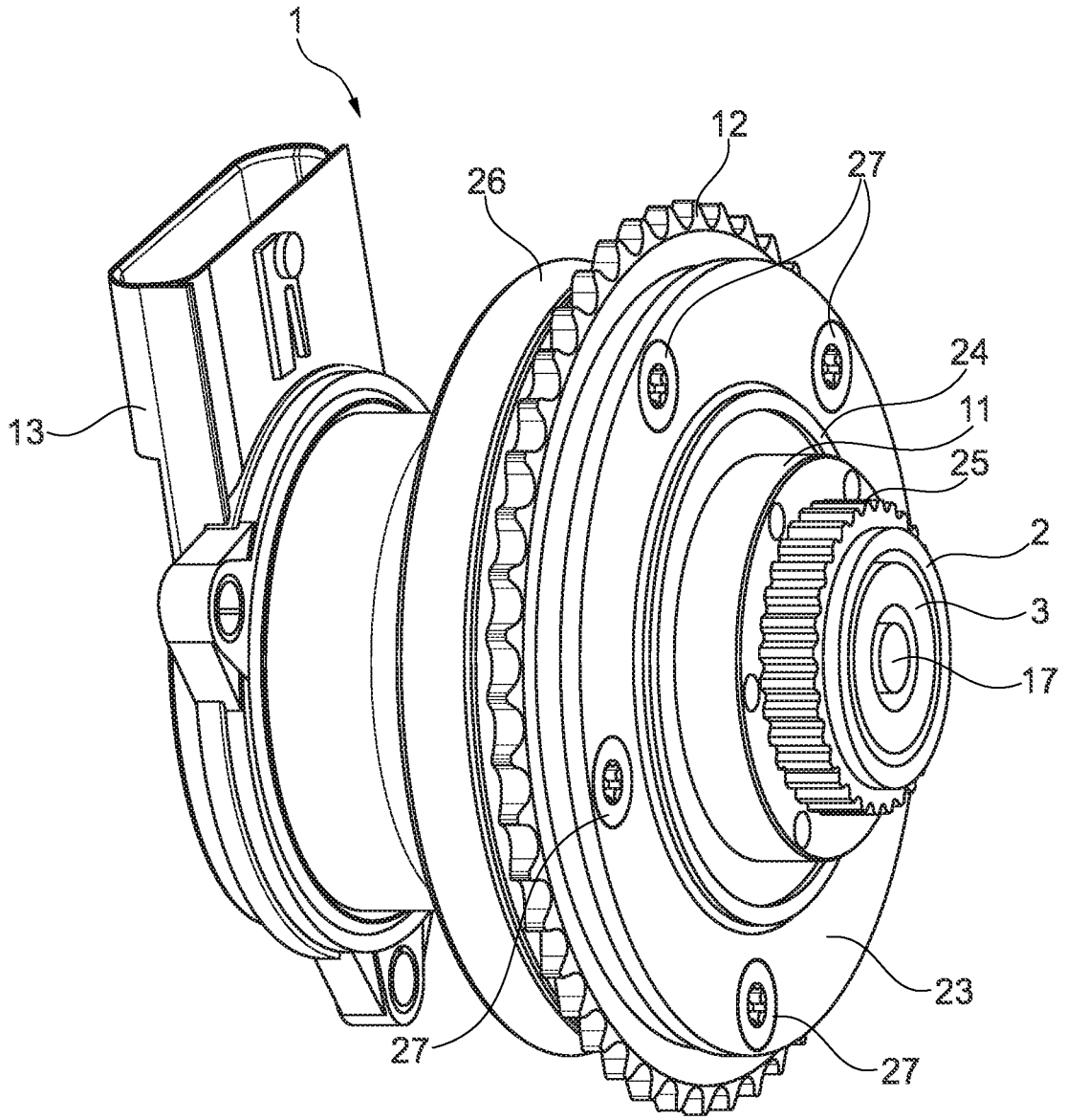
FIG. 3 shows the first exemplary embodiment of the camshaft adjusting system in a perspective view obliquely from the rear.
Figure 4:
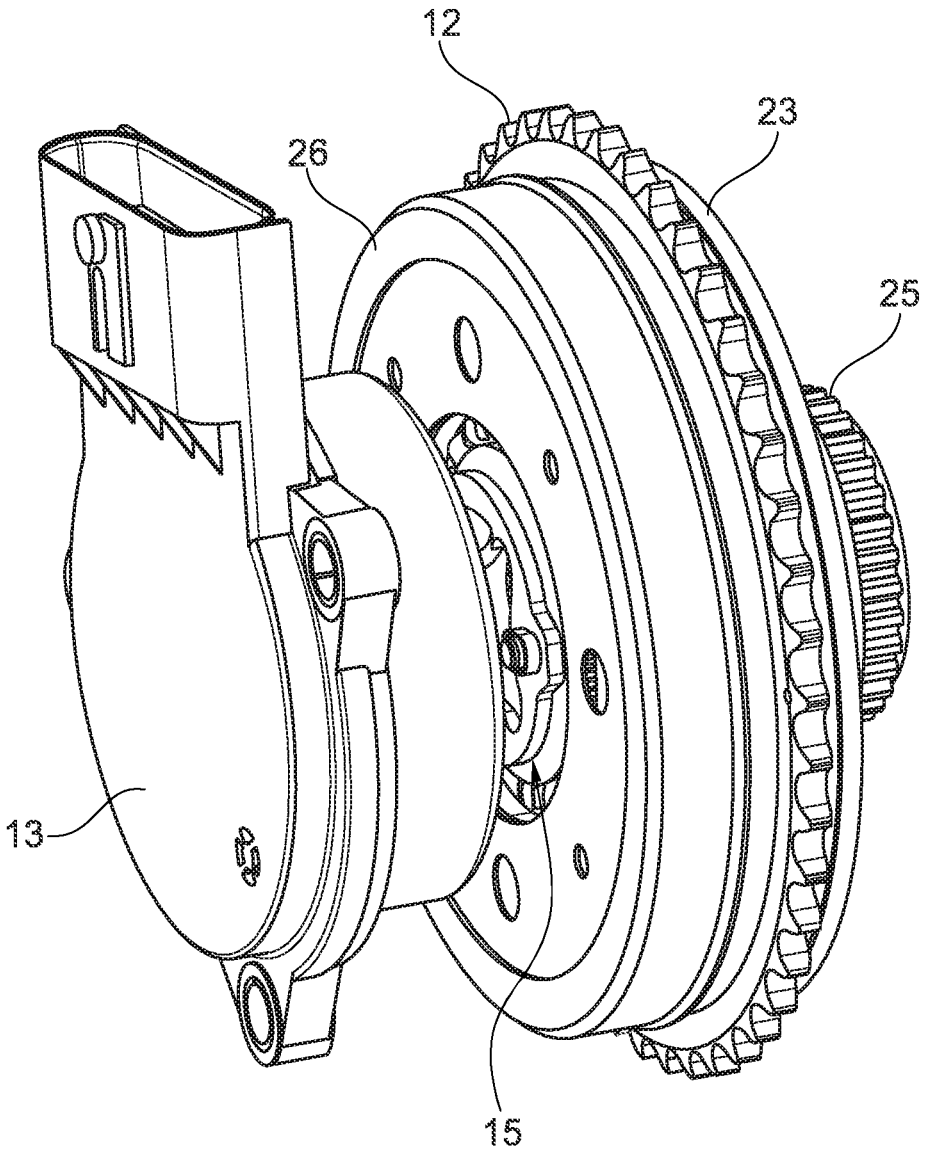
FIG. 4 shows the first exemplary embodiment of the camshaft adjusting system in a perspective view obliquely from the front.
Figure 5:
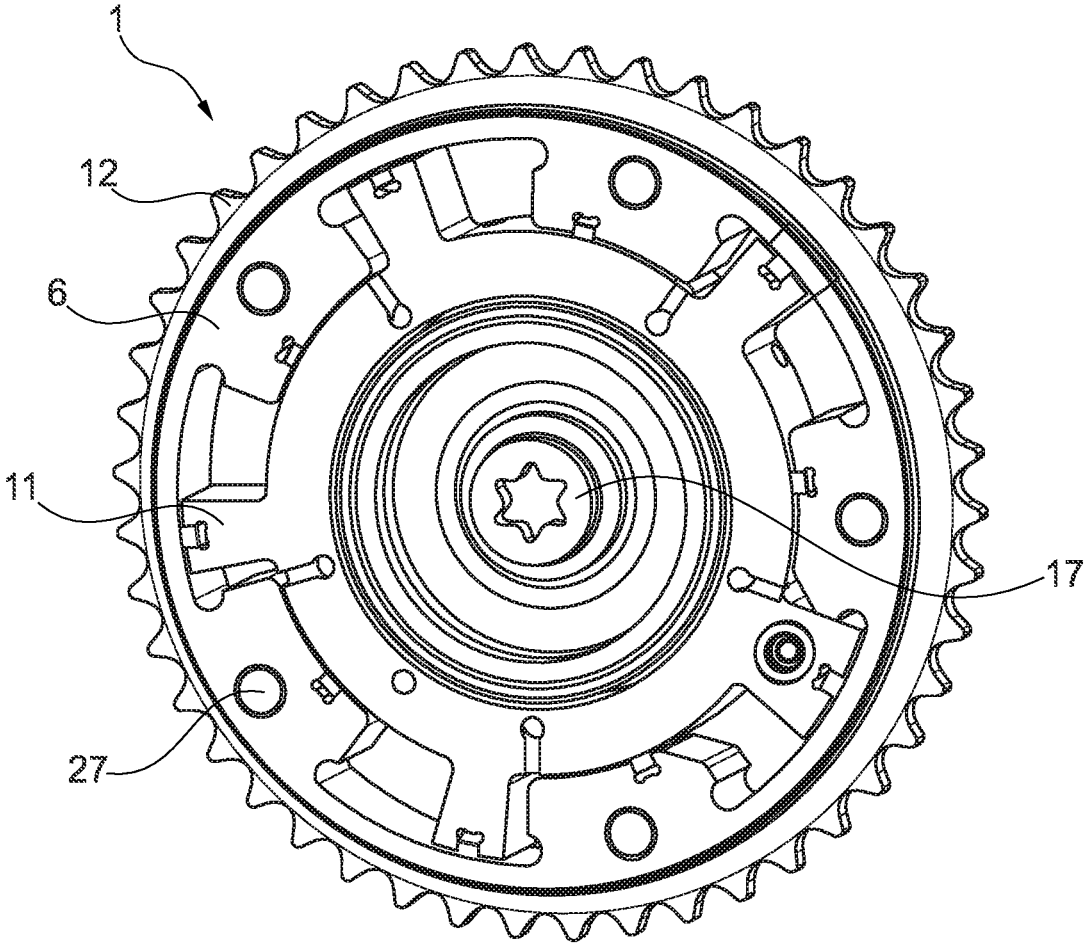
FIG. 5 shows a cross-sectional view of the camshaft adjusting system in the region of a cover toothing.
Figure 6:
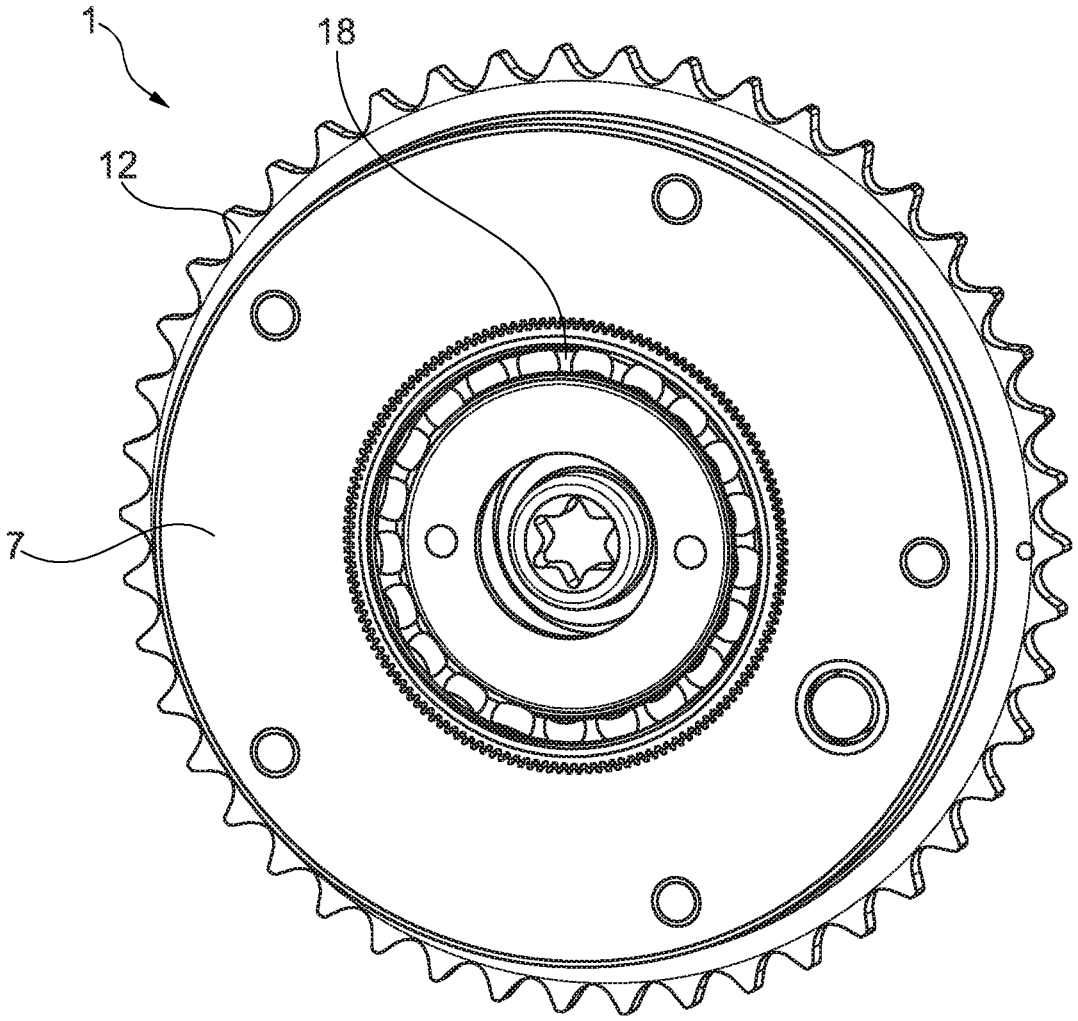
FIG. 6 shows a cross-sectional view of the camshaft adjusting system in the region of a front cover.

As can be seen in particular in FIGS. 3, 5 and 6, the front cover 7, the hydraulic camshaft adjuster 4, in the region of the stator 6, and the cover 23 are connected to one another in an axial direction by means of multiple bolts 27. The bolts 7 are, as shown here, arranged so as to be distributed uniformly over the circumference (see FIGS. 3, 5 and 6). For this purpose, the corresponding components have openings 28, as shown by way of example in FIG. 7 on the front cover 7.

FIGS. 9 to 12 show the camshaft adjusting system 1 in a second exemplary embodiment. The second embodiment corresponds substantially to the first embodiment, for which reason only the differences will be discussed below.

By contrast to the first exemplary embodiment shown in FIGS. 1 to 8, the second exemplary embodiment has no sheet-metal cover 26 which serves as a stop component. For this, the front cover 7 has, on one axial side (the side averted from the camshafts), a radially inwardly projecting ring 29, which in this case serves as the stop component (see in particular FIGS. 10 to 12). Thus, in the second embodiment, both the toothing portion 8, which serves as internal gear for the flex pot 9, and the stop component are integrated in the front cover 7.

Figure 12:
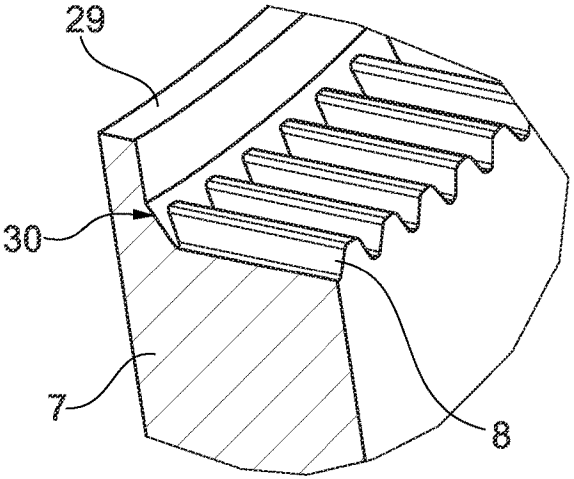
FIG. 12 shows a detail view XII from FIG. 11 in an enlarged illustration.

From the detail view in FIG. 12, it can be seen that the ring 29 is spaced apart from the toothing 8 by means of a bevel such that smooth running in the toothed engagement between the internal toothing 8 of the front cover 7 and the external toothing 10 of the flex pot 9 is not impaired.

LIST OF REFERENCE DESIGNATIONS

1 Camshaft adjusting system
2 First camshaft
3 Second camshaft
4 Hydraulic camshaft adjuster
5 Electric camshaft adjuster
6 Stator
7 Front cover
8 Internal toothing
9 Flex pot
10 External toothing
11 Rotor
12 Drive gear
13 Electric motor
14 Output shaft
15 Oldham coupling
16 Intermediate part
17 Central disk
18 Rolling bearing
19 Adapter part
20 Inner channel
21 Annular channel
22 Support/plain bearing
23 Cover
24 Rotor contact flange
25 Bearing point
26 Sheet-metal cover
27 Bolt
28 Opening
29 Ring
30 Bevel

The invention claimed is:

1. A camshaft adjusting system for a first camshaft and a second camshaft which are arranged concentrically with respect to one another, the second camshaft being arranged within the first camshaft, the camshaft adjusting system comprising:

a vane-cell type hydraulic camshaft adjuster configured for adjusting the first camshaft and including a stator and a front cover fastened to the stator that closes off the hydraulic camshaft adjuster at a side that is adapted to be facing away from the camshafts;

an electric camshaft adjuster configured for adjusting the second camshaft;

a flex pot which is configured to be attached to the second camshaft that receives torque from the electric camshaft adjuster;

the front cover includes an internal toothing that supports the flex pot.

2. The camshaft adjusting system as claimed in claim 1, wherein the front cover is an integral constituent part of the stator.

3. The camshaft adjusting system as claimed in claim 1, wherein the front cover is a component that is separate from the stator.

4. The camshaft adjusting system as claimed in claim 1, wherein the front cover includes a stop component and the internal toothing is separate from the stop component.

5. The camshaft adjusting system as claimed in claim 4, wherein the stop component has a shoulder which prevents an axial movement of at least one of the flex pot or a rolling bearing outer shell in the flex pot in a direction of an electric motor of the electric camshaft adjuster.

6. The camshaft adjusting system as claimed in claim 4, wherein the stop component engages around the front cover.

7. The camshaft adjusting system as claimed in claim 6, wherein a frictional engagement is formed between the stop component and the front cover.

8. The camshaft adjusting system as claimed in claim 1, wherein the front cover has both a stop and the internal toothing.

9. The camshaft adjusting system as claimed in claim 8, wherein the stop includes a shoulder which prevents an axial movement of at least one of the flex pot or a rolling bearing outer shell in the flex pot in a direction of an electric motor of the electric camshaft adjuster.

10. The camshaft adjusting system as claimed in claim 1, further comprising an adapter part for conducting oil arranged in an axial direction between a rotor of the hydraulic camshaft adjuster and the flex pot.

11. The camshaft adjusting system as claimed in claim 1, further comprising an intermediate part by which the flex pot is adapted to be connected to the second camshaft.

12. The camshaft adjusting system as claimed in claim 1, further comprising an Oldham coupling by which the electric camshaft adjuster is adapted to be connected to the second camshaft.

13. A camshaft adjusting unit comprising the camshaft adjusting system as claimed in claim 1 and the first and second camshafts which are arranged concentrically with respect to one another.

14. A camshaft adjusting system comprising:

a first camshaft;

a second camshaft arranged concentrically inside the first camshaft;

a vane-cell type hydraulic camshaft adjuster connected to the first camshaft and configured to adjust a relative rotational position of the first camshaft, the hydraulic camshaft adjuster including a stator and a front cover fastened to the stator that closes off the hydraulic camshaft adjuster at a side that is adapted to be facing away from the camshafts;

an electric camshaft adjuster connected to the second camshaft and configured to adjust a relative rotational position of the second camshaft;

a flex pot by which the second camshaft is connected to the electric camshaft adjuster, the flex pot receives torque from the electric camshaft adjuster; and the front cover includes an internal toothing that supports the flex pot.

15. The camshaft adjusting unit as claimed in claim 14, wherein the front cover is an integral constituent part of the stator.

16. The camshaft adjusting unit as claimed in claim 14, wherein the front cover includes a stop component and the internal toothing which is separate from the stop component.

17. The camshaft adjusting unit as claimed in claim 16, wherein the stop component has a shoulder which prevents an axial movement of at least one of the flex pot or a rolling bearing outer shell in the flex pot in a direction of an electric motor of the electric camshaft adjuster.

18. The camshaft adjusting unit as claimed in claim 14, wherein the front cover has both a stop and the internal toothing.

19. The camshaft adjusting unit as claimed in claim 18, wherein the stop includes a shoulder which prevents an axial movement of at least one of the flex pot or a rolling bearing outer shell in the flex pot in a direction of an electric motor of the electric camshaft adjuster.

* * * * *